US005147466A

United States Patent [19]

Ohmori et al.

[11] Patent Number: 5,147,466

[45] Date of Patent: Sep. 15, 1992

[54] METHOD OF CLEANING A SURFACE BY BLASTING THE FINE FROZEN PARTICLES AGAINST THE SURFACE

[75] Inventors: Toshiaki Ohmori; Itaru Kanno; Takaaki Fukumoto, all of Itami, Japan

[73] Assignee: Mitsubishi Denki Kabushiki Kaisha, Japan

[21] Appl. No.: 588,806

[22] Filed: Sep. 27, 1990

[30] Foreign Application Priority Data

Sep. 29, 1989 [JP] Japan ..... 1-252076

[51] Int. Cl.[5] ..... B08B 7/00

[52] U.S. Cl. ..... 134/7; 51/319; 51/320

[58] Field of Search ..... 134/6, 7, 13; 51/319, 51/320

[56] References Cited

U.S. PATENT DOCUMENTS

| | | | |
|---|---|---|---|
| 2,699,403 | 1/1955 | Courts | 134/7 |
| 4,617,064 | 10/1986 | Moore | 134/7 |
| 4,631,250 | 12/1986 | Hayashi | 134/7 |
| 4,655,847 | 4/1987 | Ichinoseki et al. | 134/7 |
| 4,748,817 | 6/1988 | Oura et al. | 62/74 |
| 4,932,168 | 6/1990 | Tada et al. | 51/436 |
| 4,965,968 | 10/1990 | Kelsall | 134/7 |
| 4,974,375 | 12/1990 | Tada et al. | 51/413 |

FOREIGN PATENT DOCUMENTS 63-29515 2/1988 Japan .

*Primary Examiner*—Theodore Morris
*Assistant Examiner*—Saeed Chaudhry
*Attorney, Agent, or Firm*—Leydig, Voit & Mayer

[57] ABSTRACT

To remove foreign matter (contaminants in the form of fine particles or a film of oil) deposited on a solid surface, fine frozen particles (0.01 μm to 5 mm in diameter) are used. The fine frozen particles, together with chilled nitrogen, are jetted onto the surface of a solid by the pressure of a carrier gas (nitrogen ($N_2$) gas). These fine frozen particles are produced by freezing a liquid such as water (super pure water) or alcohol. The hardness of the fine frozen particles is adjusted according to the type of liquid, the frozen freezing temperature and jetting temperature in order to control the damage to the surface of the solid. Low temperature cleaning (0° to −150° C.) in which fine frozen particles and chilled nitrogen are sprayed is achieved.

4 Claims, 2 Drawing Sheets

METHOD OF CLEANING A SURFACE BY BLASTING THE FINE FROZEN PARTICLES AGAINST THE SURFACE

BACKGROUND OF THE INVENTION

1. Field of the Invention

The present invention relates to a method of cleaning a solid surface and, in particular, to a method of cleaning a solid surface in which fine frozen particles are produced and then sprayed onto the surface of a solid, such as a semiconductor wafer or reticle printed board or the like, in order to remove contaminants deposited on the solid surface.

2. Description of the Related Art

FIGS. 1 and 2 are views for explaining this type of conventional cleaning method which is applied to a general degreasing cleaning or a general cleaning as a substitution for trichloroethylene cleaning, freon cleaning or the like. To remove contaminants deposited on the surface of a solid such as a semiconductor wafer, super pure water is jetted onto the surface, a solid 2 to be cleaned from a jet nozzle 1 at a high pressure of 30 $Kg/cm^2.G$ or greater, as shown in FIG. 1. Thus, a contaminant 3 is removed from the surface of the solid 2. As shown in FIG. 2, the contaminant 3 is also sometimes removed from the surface of the solid 2 by super pure water which is sprayed onto the surface of the solid 2 to be cleaned, from the jet nozzle 1, and at the same time a cylindrical brush 5 having a rotational axis 4 rotates in the direction of an arrow A and slides in the direction of an arrow B with contact to the surface of the solid 2.

As described above, a conventional method of cleaning a solid surface has been performed by the use of the pressure of a liquid such as jetted super pure water, and frictional force made by a brush. However, the conventional method of cleaning a solid surface has the following problems. As contaminants become very fine (particle size: 10 μm or smaller), the sticking force of the contaminants to the surface of a solid to be cleaned increases, and the force of a usual jetting of a liquid to remove such fine contaminants is too weak, and thus the cleaning effect (or a removal effect) is insufficient. If the liquid jetting pressure is increased (100 $Kg/cm^2.G$ or greater), a part of the inner side of the jet nozzle is worn away due to the flowing of the liquid against it. This worn away part is jetted together with the liquid, causing the surface of a solid to be contaminated. If a brush is used, there is a danger that the surface to be cleaned will be contaminated due to the wearing of the brush, and that contaminants attached to the brush, which is removed from the surface of a solid, will be deposited again onto the surface of a solid to be cleaned.

SUMMARY OF THE INVENTION

The present invention has been devised to solve the above-described problems. An object of the present invention is to obtain a method of cleaning a solid surface efficiently removing foreign matter deposited on a solid surface by a strong adhesive force, e.g., contaminants in the form of fine particles or a film of oil, or the like.

In view of the above-described object, the present invention comprises the steps of spraying fine frozen particles formed by freezing a liquid onto the surface of a solid to be cleaned and varying the hardness of fine frozen particles to adjust damage to the surface of the solid.

In the above method of cleaning a solid surface of the present invention, to remove foreign matter (contaminants in the form of fine particles or a film of oil, or the like) deposited on a solid surface, fine frozen particles (0.01 μm to 5 mm) are used. The fine frozen particles are jetted onto the solid surface together with nitrogen chilled air by a carrier gas (nitrogen ($N_2$) gas). These fine frozen particles are produced by freezing a liquid such as water (super pure water) or alcohol. The hardness of these particles is adjusted by changing type of liquid and the ice making and jetting temperatures so that damage to the solid surface is adjusted. The present invention is also characterized by a low temperature cleaning (−150° to 0° C.) in which fine frozen particles and nitrogen chilled air are sprayed.

In the present invention, contaminants are removed by kinetic energy when the fine frozen particles are jetted and collide with the solid surface. When the contamination is an oily film and the like, low temperature cleaning is performed so that the contaminants are firstly solidified and then removed. In the case of organic films, in particular, there is a contraction due to the temperature variation, and adhesion between the contamination and the surface of a solid is decreased. Therefore, the organic films become easy to remove. If the hardness of the fine frozen particles is made softer than that of the surface of a solid to be cleaned, when the fine frozen particles collide with the surface of a solid to be cleaned, the above fine frozen particles are finely crushed. Hence, there are advantages in that the above crushed fine frozen particles absorb and remove the contaminants in the form of particles on the surface to be cleaned and the above frozen particles move on the surface to be cleaned without bouncing on the surface and thus scrub the contaminants from the solid surface and remove the same.

These and other objects, features and advantages of the present invention will become clear when reference is made to the following description of the preferred embodiments of the present invention, together with reference to the accompanying drawings.

DESCRIPTION OF THE PREFERRED EMBODIMENTS

Figures 3A, 3B, 3C:
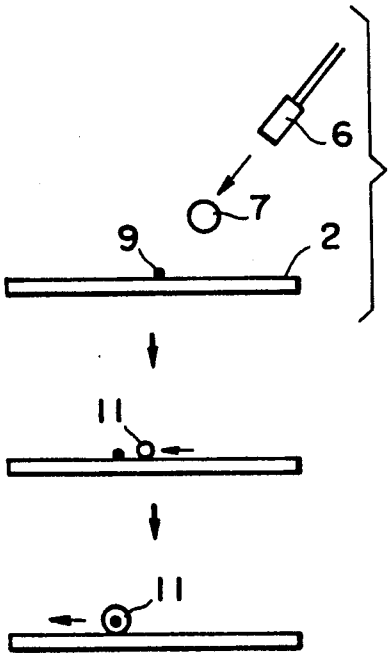
FIGS. 3(*a*)–3(*c*) explain a method according to the present invention for cleaning a solid surface.

An embodiment of the present invention will be explained hereinunder with reference to the accompanying drawings. FIGS. 3(*a*)–3(*c*) explain a method for cleaning a solid surface according to the present invention. In the present invention, a liquid, e.g., water (super pure water) or alcohol is frozen to produce fine frozen particles 7 (particle size: 0.01 μm to 5 mm). These particles are sprayed toward the surface of the solid 2 to be cleaned by the pressure (1 to 10 $Kg/cm^2.G$) of a carrier gas of, e.g., nitrogen gas from a jet nozzle 6. As regards a method and an apparatus for producing fine frozen particles, such a method and apparatus is disclosed in, for example, Japanese Published Patent Application 63-29515, and an explanation thereof is omitted. In causing these fine frozen particles 7 to be jetted, the hardness of the fine frozen particles 7 is made equal to or smaller than that of the solid surface 2 so that the solid surface 2 will not be damaged. The hardness of the fine frozen particles 7 is adjusted by varying the type of a liquid to be frozen. An example of this is shown in Table 1.

TABLE 1

| Solvent | Mohs hardness of frozen material |
|---|---|
| Water + Methanol | 1 to 2 |
| Methanol | 1 to 2 |
| Glycerin | 2 |
| Freon 113 | 2 |
| Water | 4 |

Figure 1:
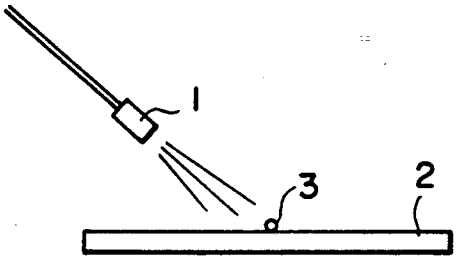
FIG. 1 PRIOR ART
FIGS. 1 and 2 are schematic views explaining a conventional method of cleaning a solid surface.
Figure 2:
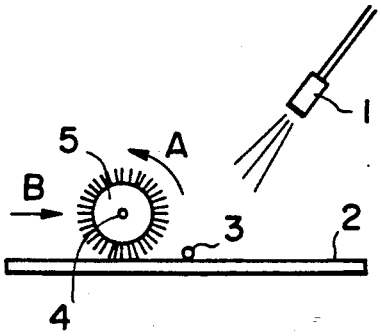
FIG. 2 PRIOR ART
Figure 5:
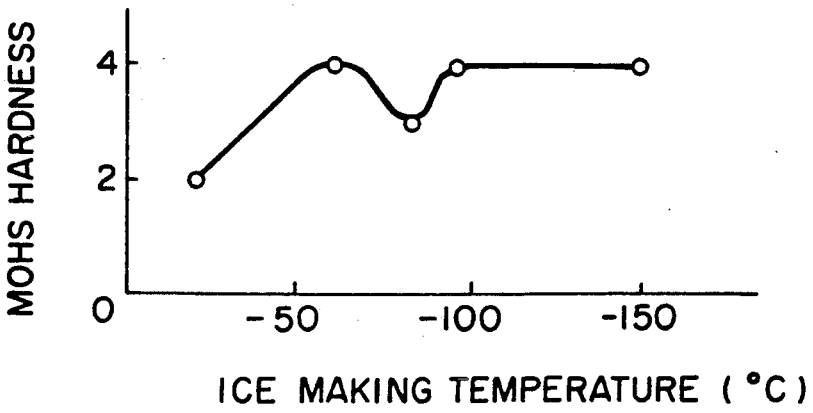
FIG. 5 shows the relationship between the hardness of frozen pure water and ice making temperatures.

The hardness of fine frozen particles can also be varied by varying the ice making temperature or the jetting temperature of the fine frozen particles. The relationship between the hardness of frozen pure water and the ice making temperatures is shown in FIG. 5.

The mechanism for cleaning and removing contaminants in the form of fine particles according to the present invention will be explained with reference to FIGS. 3(*a*)–3(*c*). The fine frozen particles 7 are crushed into smaller fine frozen particles 11 because of the differences in hardness when they collide with the solid 2 to be cleaned. These crushed fine frozen particles 11 collide with the contaminants in the form of fine particles 9, and a part of these particles 11 absorb and remove the contaminants in the form of fine particles 9.

Figures 4A, 4B, 4C, 4D, 4E:
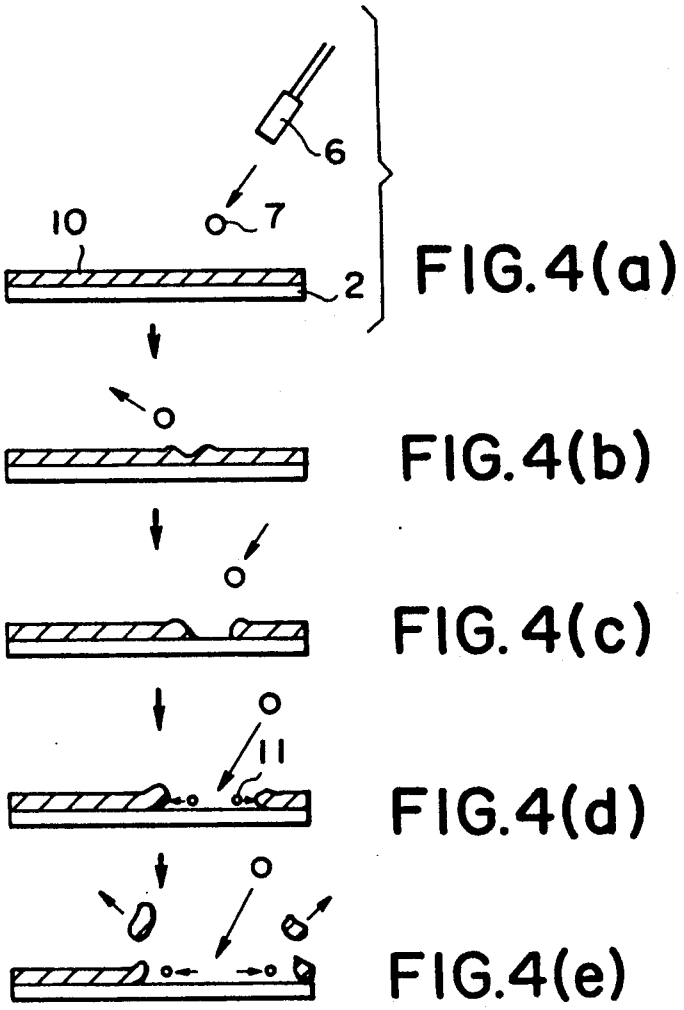
FIGS. 4(*a*)–4(*e*) explain a method according to the present invention for cleaning a solid surface by removing organic films.

FIGS. 4(*a*)–4(*e*) shows the mechanism of the present invention in removing an organic film of oil or the like. First, the fine frozen particles 7 collide with an organic film 10. Since the hardness of the organic film 10 is lower than the fine frozen particles 7, that is, the organic film 10 is softer, irregularities occur on the surface of the organic film 10. When the collision of the fine frozen particles 7 is repeated several times, the irregularities on the surface of the organic film 10 become larger so that a part of the surface of the solid 2 to be cleaned is exposed. The fine frozen particles 7 that have collided with the solid surface 2 are crushed into more fine frozen particles 11 on the surface because the particles 7 are not as hard as the solid 2. The fine frozen particles 7 scrub the surface of the solid 2 without bouncing on the surface of the solid 2 and then collide with the side wall of the organic film 10. If nitrogen gas (not particularly shown) for injecting the fine frozen particles 7 is jetted together with the particles 7 so as to collide with the organic film 10, the organic film 10 is cooled, so that it solidifies and contracts. Thus, adhesion between the organic film 10 and the surface of the solid 2 is decreased. The low temperature cooling of the organic film 10 to decrease adhesion between the organic film 10 and the surface of the solid 2 in cooperation with the fine frozen particles 11 scrubbing the surface of the solid 2 enables the organic film 10 to be removed more efficiently. Further, when the fine frozen particles strike a solid to be cleaned, a portion of the surfaces of the particles liquefies, surface tension occurs instantaneously and then the surfaces of the particles solidify again. At that time, contaminants or oil on the surface of a solid are partially absorbed into the particles and the next fine frozen particles wash away and remove them. The above-described cleaning mechanism acts in a combined form according to the properties of the solid to be cleaned. Table 2 shows a comparison of the present invention of cleaning a solid surface and a conventional method of cleaning a solid surface as regards the effect of removing polystyrene latex particles having a particle size of 0.322 μm.

TABLE 2

| Method of Cleaning | Removal Factor | Conditions |
|---|---|---|
| Ice scrubber (The present invention) | 97.6% | Jetting pressure 30 Kg/cm$^2$ |
| Brush scrubber | 87.4% | Brush pressure 0.8 Kg/cm$^2$ |
| High-pressure jet water | 84.4% | Water pressure 100 Kg/cm$^2$ |

As has been explained above, according to the present invention, when contaminants in the form of fine particles or organic films deposited on the surface of a solid are removed, fine frozen particles are jetted, and the hardness of these fine frozen particles is adjusted according to the hardness of the solid surface. Thus, a higher removal effect, i.e., cleaning effect, can be obtained.

What is claimed is:

1. A method of cleaning a surface comprising:

selecting a temperature between −20° C. and −100° C. for freezing water to produce fine frozen particles having a hardness no harder than the hardness of a surface to be cleaned by blasting the fine frozen particles against the surface;

freezing the liquid at the selected temperature to produce fine frozen particles; and blasting the fine frozen particles against the surface with a carrier gas at a gauge pressure in a range from 1 to 10 Kg/cm$^2$, thereby cleaning the surface.

2. A method of cleaning a surface as claimed in claim 1 including jetting the fine frozen particles with nitrogen as the carrier gas.

3. A method of cleaning a surface as claimed in claim 1 including blasting the fine frozen particles with chilled nitrogen as the carrier gas to clean the surface at a low temperature.

4. A method of cleaning a surface as claimed in claim 3 including removing a film from the surface.

* * * * *